United States Patent [19]

Jacobs

[11] 4,180,218

[45] Dec. 25, 1979

[54] CREEL

[75] Inventor: David R. Jacobs, New Canaan, Conn.

[73] Assignee: Abram N. Spanel, Princeton, N.J.

[21] Appl. No.: 877,632

[22] Filed: Feb. 14, 1978

[51] Int. Cl.[2] ..... B65H 49/02

[52] U.S. Cl. ..... 242/131

[58] Field of Search ..... 242/131, 131.1; 28/32, 28/34

[56] References Cited

U.S. PATENT DOCUMENTS

| | | | |
|---|---|---|---|
| 2,483,160 | 9/1949 | Suggs | 242/131.1 |
| 2,710,155 | 6/1955 | Borges, Jr. | 242/131.1 |
| 3,150,845 | 9/1964 | Pool | 242/131 |

*Primary Examiner*—Leonard D. Christian

*Attorney, Agent, or Firm*—Steele, Gould & Fried

[57] ABSTRACT

A creel for yarn bobbins or the like, comprising a plurality of yarn bobbin support members disposed in at least two adjacent rows, means for mounting at least two yarn bobbins on either side of each of the supports, and means on each of the yarn bobbin supports for receiving and guiding yarn from the bobbins mounted on supports in the adjacent row. The yarn bobbin mounting means includes swingably mounted spindles permitting each to be disposed in an operative or a loading position. Each of the yarn bobbins is axially directed to one of the yarn receiving and guiding means in the adjacent row in the operative position. In a preferred embodiment, pairs of yarn bobbins are axially directed to the same one of the yarn receiving and guiding means.

21 Claims, 6 Drawing Figures

48

CREEL

BACKGROUND OF THE INVENTION

I. Field of the Invention

The present invention relates to the general field of creels used for tufting and other yarn processes, and in particular, to creels for supporting a plurality of yarn bobbins.

II. Description of the Prior Art

The most significant problem encountered in the design of large scale yarn creel systems is the difficulty in achieving efficient utilization of space, particularly floor space, while maintaining convenient means for servicing the yarn bobbins. Some of the proposed solutions to one or both aspects of this problem, found in the prior art, include the use of yarn bobbins disposed in an alternating geometrical pattern. One such creel comprises horizontal layers of vertically disposed yarn creels, wherein the creels of each layer face upwardly and downwardly in an alternating pattern.

Another such creel for supporting a plurality of spools comprises a plurality of spool holders to receive the spools thereon; the spool holders extending generally horizontally and disposed in an arcuate array about a focal take-off element. Multiple arcuate arrays are disposed in staggered back-to-back relation in order to develop close packing of the arrays. Each spool holder is also said to be exposed to provide ready access for loading the spools. In order to do so, one must work inside the confines of the creel frame structure, because the arrangement of the spool holders dictated by the arrangement of the multiple arcuate arrays, seems to preclude the use of pivotally and swingably mounted spool holders.

In contrast, the yarn creel of the present invention not only provides a geometrically closed-packed structure, but also provides for swingably and pivotally mounted spool or yarn bobbin holders, in order to facilitate loading and unloading yarn spools or bobbins.

In a third kind of creel known to the art, the direction of the take-off points of the yarns are arranged on the rack so that the converging triangles formed by the axes of the yarn cones are nested together. In one embodiment, a rack is constructed from vertical and horizontal angle iron members and the bobbins are removably supported on cone holder brackets bent in a shape similar to bicycle handlebars which are welded in the middle to a post and each handle provides a member on which a bobbin or yarn package is removably supported. The direction of the take-off points of the yarn is arranged alternately so that the converging triangles formed by the axes of the yarn cones are nested together. In one form, space is conserved within the rack but more aisles are necessary. In another form, no aisles are provided but servicing must be performed from the floor around the rack. This arrangement can seemingly provide a savings in space at the expense of convenience, or additional convenience at the expense of additional savings in space, but not both simultaneously.

The yarn creel according to the present invention, by its disposition of yarn bobbins in alternately disposed converging or diverging pairs, and by utilization of swingable and pivotal yarn bobbin support means, solves both aspects of the basic problem simultaneously.

SUMMARY OF THE INVENTION

It is an object of the subject invention to provide an improved creel for yarn bobbins or the like which efficiently utilizes available floor space.

It is a further object of the subject invention to provide an improved creel for yarn bobbins or the like which efficiently utilizes available floor space while maintaining convenience in maintenance.

It is a still further object of the subject invention to provide an improved creel for yarn bobbins or the like which utilizes a plurality of support memebers alternately disposed in two adjacent rows, with each of the supports bearing both yarn bobbins and yarn guide-receiving means.

It is another object of the subject invention to provide an improved creel for yarn bobbins or the like which utilizes a plurality of support members alternately disposed in two adjacent rows, with each of the supports bearing both yarn bobbins and yarn guide-receiving means, and wherein yarn bobbins in one of said rows are operatively associated only with yarn guuide-receiving means in the other of said two rows, and vice versa.

It is yet another object of the subject invention to provide an improved creel for yarn bobbins or the like which utilizes a close-packed geometrical structure which is easily duplicated in a series of layers or tiers.

It is yet another object of the subject invention to provide an improved creel for yarn bobbins or the like, utilizing a close-packed geometrical structure, and providing swingable and pivotal mounting means for the yarn bobbins.

It is another object of the subject invention to provide an improved creel for yarn bobbins which is easily shipped and can be readily assembled because of its unit design which permits modular or add-on usage.

It is still another object of the subject invention to provide an improved creel for yarn bobbins wherein assembly thereof is facilitated because of the interchangeability of many of the parts.

Briefly, a creel for yarn bobbins or the like according to the present invention comprises a plurality of yarn bobbin support members disposed in two adjacent rows, means for mounting at least two yarn bobbins on either side of each of the yarn bobbin support members, and means on each of the yarn bobbin supports for receiving and guiding yarn from the bobbins mounted on the yarn bobbin support members in the adjacent row. The yarn bobbin mounting means includes swingably mounted spindles permitting each yarn bobbin to be disposed in an operative or a loading position. Each of the yarn bobbins, when in the operative position, is axially directed to one of the yarn receiving and guiding means in the adjacent row. In a preferred embodiment, each yarn receiving and guiding means is operatively associated with two yarn bobbins, with the yarn guide and receiving means and the corresponding yarn bobbins being mounted in opposite rows. Bracing structure may also be provided when deemed necessary.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENT

Figure 1:
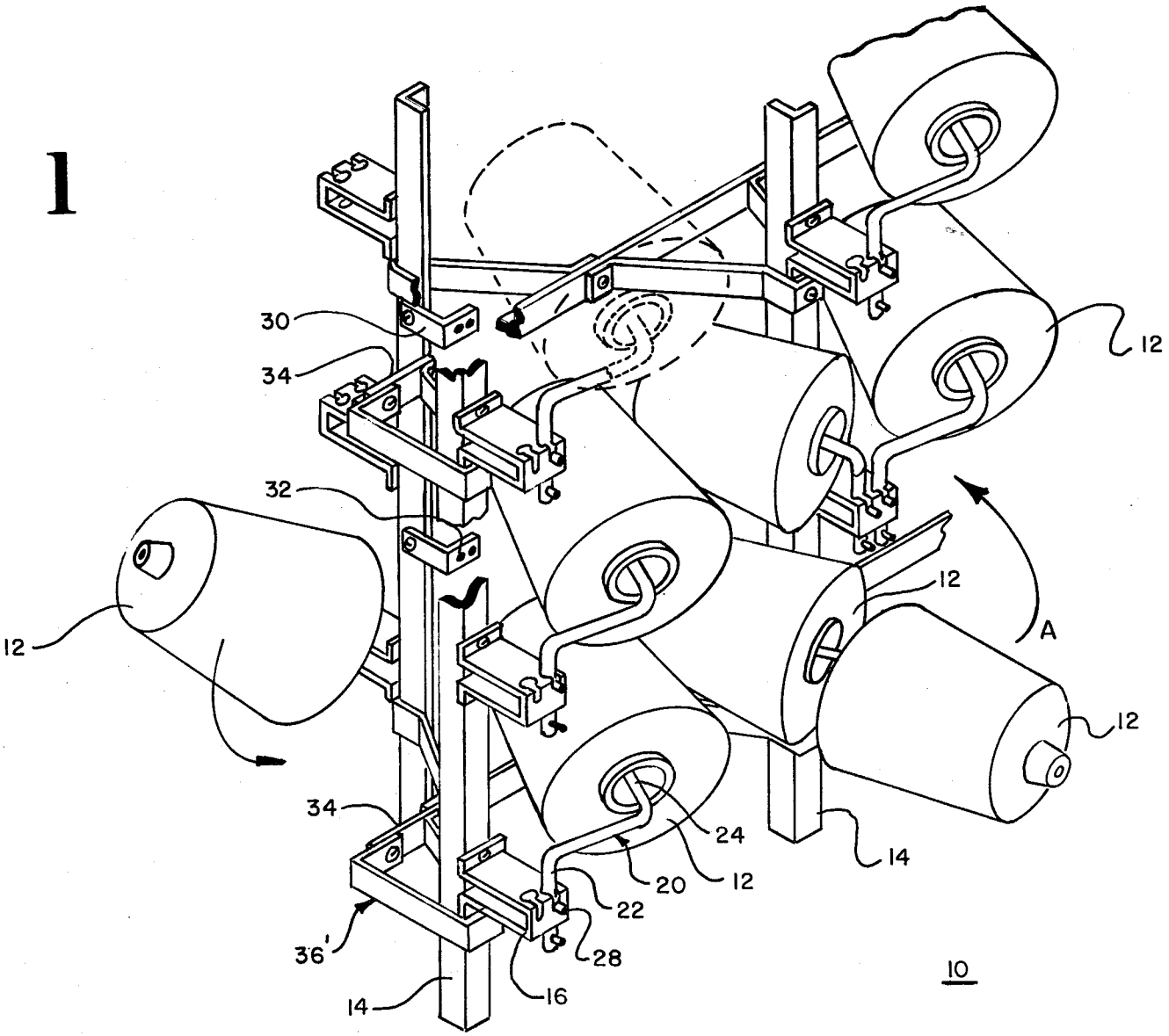
FIG. 1 is a perspective view of a representative portion of a yarn creel according to the subject invention, partially cut away and partially shown in phantom.
Figure 2:
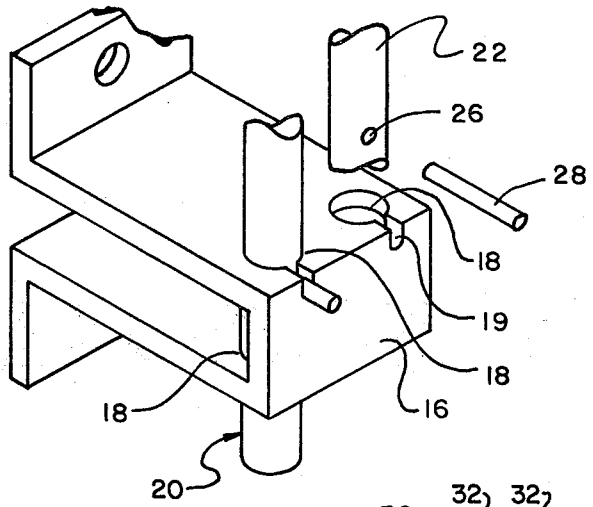
FIG. 2 is an exploded, perspective view of yarn bobbin mounting means according to the subject invention.
Figure 4:
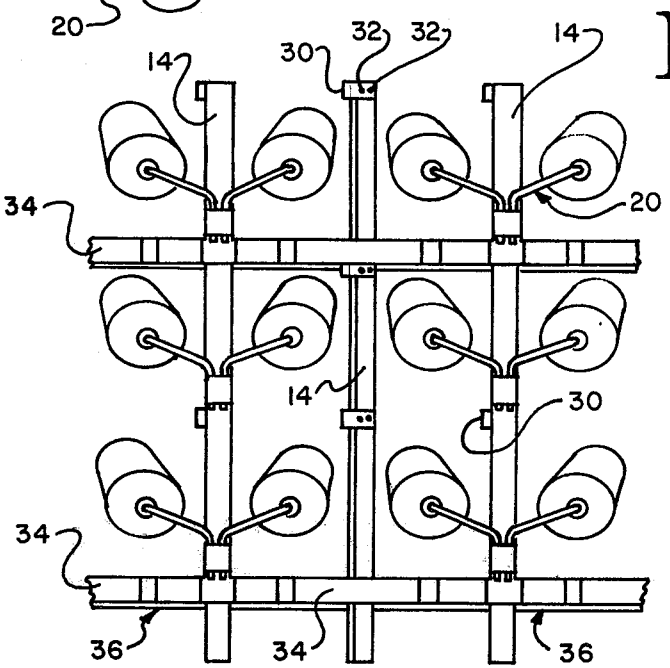
FIG. 4 is a representative front view of a portion of a yarn creel according to the subject invention.
Figure 5:
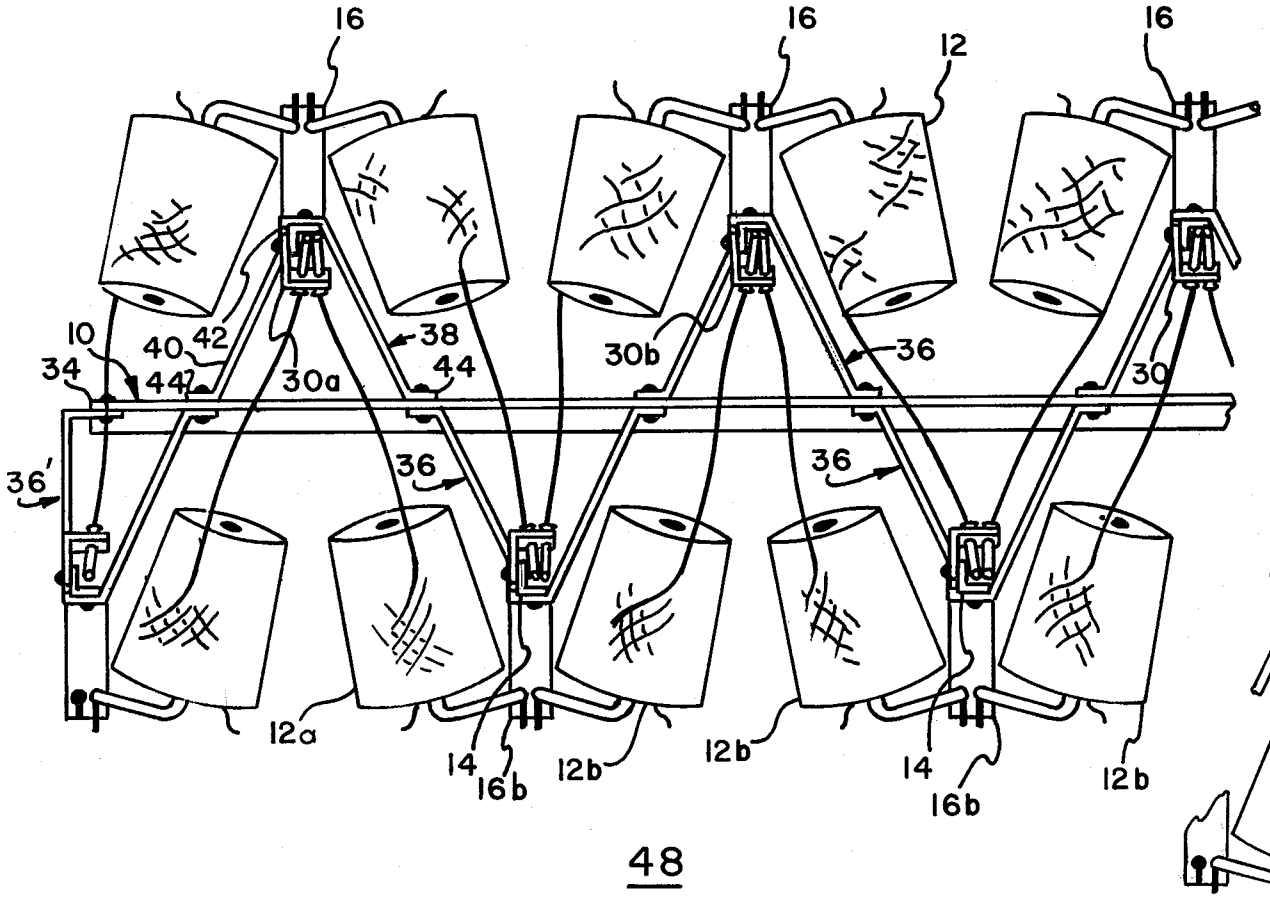
FIG. 5 is a top view of a representative portion of a yarn creel according to the subject invention which is shown set up as a non-magazine creel for a sample run; and, FIG. 6 is a top view of a representative portion of a yarn creel according to the subject invention which is shown set up for a production run.

With reference to the Figures, wherein like numerals denote like elements, there is shown a presently preferred embodiment of a yarn creel 10 according to the present invention. With reference to FIGS. 1 and 5, a plurality of yarn bobbins 12 are mounted on a plurality of yarn bobbin support members 14, which are disposed alternately in two adjacent rows. Each yarn bobbin support member 14 carries a plurality of yarn bobbin mounting means. As shown in FIG. 2, the yarn bobbin mounting means may include a plurality of spindle supports 16. Each spindle support 16 is shown having two sets of vertically aligned holes 18 with the top holes of each support shown having recessed notches 19. Each of the yarn bobbins 12 is mounted on a yarn bobbin spindle generally designated by numeral 20, having a circular cross section. Each yarn bobbin spindle 20 is formed with two bends, as indicated by numerals 22 and 24. Bend 22 defines the top of that portion of the yarn bobbin spindle 20 which is insertable into each set of vertically aligned holes 18. In order to prevent the yarn spindles 20 from falling or travelling too far through the spindle support 16, each yarn spindle 20 has stop means in the form of a pin 28, mounted through a transverse bore 26 in the yarn bobbin spindle 20. When a yarn bobbin 12 is mounted by the means shown and described herein, it is in fact pivotally and swingably mounted such that it is free to be moved along an arc indicated by A in FIG. 1. As the bobbin 12 swings to its operative position, the pin 28 will seat in the corresponding recessed notch 19 which serves to lock the bobbin 12 in its operative position. As is particularly evident in FIGS. 3 and 4, the plurality of yarn bobbins 12 are mounted in vertical layers or tiers. The bends 22 and 24 in the yarn spindles 20 are formed at such angles that any yarn bobbin can be swung from an operative position, such as that shown in FIGS. 3, 4 and 5, to a loading or non-operative position, such as that indicated by the yarn bobbin in FIG. 1 which is associated with arc A. The bends 22 and 24 are also formed at angles which cause the yarn bobbins to be upwardly disposed as well.

In addition to carrying a plurality of yarn bobbin spindle supports 16, each yarn bobbin support member 14 has mounted thereon a plurality of yarn receiving and guiding means, in the form of an L-shaped bracket 30, one section of which has two holes 32 therethrough for receiving individual yarn strands. With reference to FIGS. 4 and 5, it may be seen that each yarn guiding means 30 (including **30*a* and 30*b*) receives and guides yarn from two yarn bobbins which are mounted on yarn bobbin support members in the other or opposite row of yarn bobbin support members. It is also evident from FIGS. 4 and 5 that the yarn bobbins mounted on each yarn bobbin mounting spindle support 16 (including 16*a* and 16*b*) are operatively associated with separate yarn receiving and guiding means 30 (including 30*a* and 30*b*) mounted on adjacent yarn bobbin supports 14** in the other or opposite row of yarn bobbin support members.

Based on the foregoing, it is possible to describe the close-packed geometrical structure of the yarn creel according to the present invention in two convenient ways, as shown in FIG. 5. In the first way, a pair 46 of yarn bobbins **12*a* is mounted on each yarn bobbin mounting spindle support 16*a*. The yarn bobbins 12*a* of each yarn bobbin pair 46 have divergently directed longitudinal axes, with each yarn bobbin 12*a* being operatively associated with the closest yarn receiving and guiding means 30*a* in the opposite row of yarn bobbin support members 14 from that row in which the yarn bobbin support member 14 carrying yarn bobbin pair 46** is disposed.

A second way of describing the close-packed geometrical structure of the yarn creel according to the present invention is shown by yarn bobbins **12*b*, which comprise yarn bobbin pair 48. The yarn bobbins 12*b* of yarn bobbin pair 48 are mounted on yarn bobbin mounting spindle supports 16*b*, which are in turn mounted on adjacent yarn bobbin support members 14 in the same row. Accordingly, the yarn bobbins 12*b* of the yarn bobbin pairs 48 have convergent longitudinal axes, and are operatively associated with the same yarn guiding and receiving means 30*b*, which is itself mounted on the closest yarn bobbin support member 14 in the row of yarn bobbin support members opposite to the row of yarn bobbin support members in which yarn bobbin pair 48** is mounted.

Figure 3:
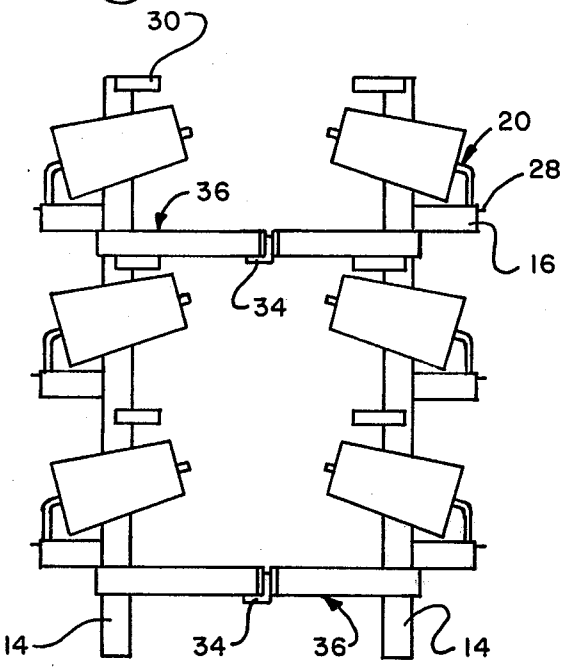
FIG. 3 is a representative end view of a yarn creel according to the subject invention.

It is therefore apparent that a yarn creel according to the present invention may be considered as either a plurality of yarn bobbin pairs 46, each of which is operatively associated with two yarn receiving and guiding means, or as a plurality of yarn bobbin pairs 48, each of which is operatively associated with one yarn guiding and receiving means. In either case, yarn bobbins in one of two adjacent rows of yarn bobbins are operatively associated with yarn receiving and guiding means in the other of the two adjacent rows, and vice versa. Either description ultimately describes the same close-packed geometrical structure which enables a high density of yarn bobbins to be mounted in a relatively small area, while at the same time, maintaining great convenience in maintenance. The basic geometrical structure shown in FIG. 5 and described herein may be repeated in a plurality of vertical tiers or layers, as shown in FIGS. 1, 3 and 4. The two rows of yarn bobbin support members 14 may be mounted and held in a vertical position by any convenient means. They may be directly embedded into a concrete floor, they may be bolted to a floor or they may be secured to a rectangular framed base, which is itself on wheels. Those skilled in the art will appreciate that many such means are available.

Figure 6:
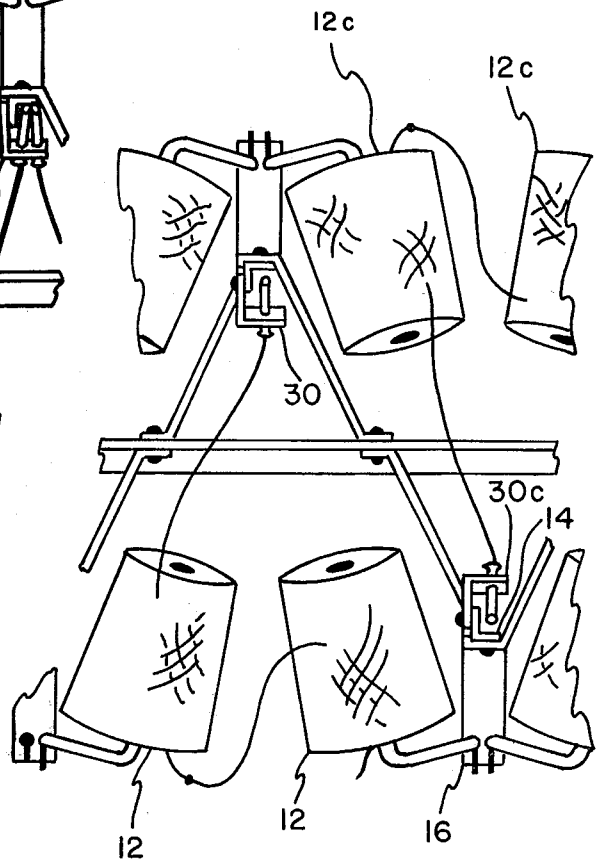

As the plurality of the yarn bobbins 48 is shown in FIG. 5, yarn strands from individual bobbins **12*b* extend to the yarn receiving and guiding means 30*b* on their way to the tufting or other type of textile machinery. In this format with yarn strands extending from both adjoining bobbins 12*b*, the creel would be set up for non-magazine or sample use. This operational format should be compared to FIG. 6 where yarn bobbins 12***c* have their axes converging to yarn guiding and receiving means 30*c*, however, a yarn strand extends to 30*c* from only one yarn bobbin 12*c*, while the lead yarn strand from the second yarn bobbin 12*c* extends to the first yarn bobbin 12*c*. Accordingly, FIG. 6 shows a creel magazine set up which is geared for a production run and by appropriate connecting of the yarns, when all of the yarn from the first bobbin 12*c* is used, the yarn supply will continue with the yarn coming directly from the second bobbin 12*c* allowing the first used bobbin to be replaced without interruption of the yarn supply to the textile machine.

It may be desirable, although not necessary, to provide additional structural elements to increase the overall strength and rigidity of the yarn creel 10. One convenient method chosen for the presently preferred embodiment is the use of intermediate longitudinal members 34, which are attached to the plurality of yarn bobbin support members 14 by a plurality of substantially V-shaped brace members generally designated by numeral 36. Each V-shaped brace member 36 has a corner-shaped section 42, two sides 38 and 40 and two leg or base sections 44. The V-shaped braces are attached in an alternate fashion, in accordance with the alternate disposition of the yarn bobbin support members 14, as shown in FIG. 5. The bracing may be placed in alternating or skipped levels, as shown in FIGS. 3 and 4. The end V-shaped member 36', is similar in structure and function, although not identical in shape to V-shaped brace members 36.

It will be apparent to those skilled in the art that the particular bracing structure, or even the need for a bracing structure, is not a fundamental part of the present invention. The operative elements of the yarn creel according to the present invention, which generally include yarn bobbin mounting spindle supports 16, yarn bobbins 12, yarn bobbin spindles 20, and yarn guiding and receiving means 30, are all mounted only on the yarn bobbin support members 14, and do not depend in any way on any of the elements in the bracing structure.

As indicated in the Figures, many of the structural elements, such as yarn bobbin support members 14, longitudinal member 34 and yarn guiding and receiving means 30 may be conveniently constructed from sections of angle iron or the like. The V-shaped brace members 36 and 36', as well as the yarn bobbin mounting spindle supports 16 can be pre-bent or pre-shaped from flat metal stock or the like. The various structural elements can be bolted together, riveted or welded.

The present invention may be embodied in other specific forms without departing from the spirit or essential attributes thereof, and accordingly, reference should be made to the appended claims, rather than to the foregoing specification as indicating the scope of the invention.

I claim:

1. A creel for yarn bobbins, comprising:

a plurality of support members disposed in at least two adjacent rows;

means for mounting at least one bobbin on each side of said support member;

means on at least one of said support members in the first row for receiving and guiding yarn from at least one of said bobbins mounted on said support members in the second row; and, means on at least one of said support members in the second row for receiving and guiding yarn from at least one of said bobbins mounted on said support members in the first row.

2. The creel of claim 1, wherein said plurality of support members are disposed alternately in said adjacent rows.

3. The creel of claim 1, wherein two of each of said bobbins mounted in one of said two rows is axially directed to one each of the support members in the other of said two rows.

4. The creel of claim 1, wherein each row has at least two bobbins and each yarn receiving and guiding means receives yarn from the nearest of said bobbins mounted in the adjacent row.

5. The creel of claim 4, wherein each of said yarn bobbins is axially directed to one of the yarn receiving and guiding means in the adjacent row.

6. The creel of claim 1, wherein pairs of said yarn bobbins are axially directed to the same one of said yarn receiving and guiding means.

7. The yarn creel of claim 1, wherein said means for mounting the yarn bobbins includes swingably mounted spindles for supporting said bobbins.

8. The creel of claim 7, wherein each of said spindles is formed to permit each of said bobbins to be movable from an operational position to a non-operational position without disturbing any other of said bobbins.

9. The creel of claim 1, comprising at least two tiers of said bobbin mounting means and said yarn guiding and receiving means on said support members.

10. The creel of claim 1, wherein each of the yarn guiding and receiving means is disposed above one of the bobbin mounting means.

11. The creel of claim 1, wherein pairs of said bobbins and one of said yarn receiving and guiding means occupy configurated sectors of economical space use.

12. The creel of claim 11, wherein said triangular sectors form an opposite, alternating pattern between said two rows.

13. The creel of claim 11 wherein the configurated sector is triangular.

14. A creel for yarn bobbins, comprising:

a plurality of yarn bobbin supports disposed in two adjacent rows;

means for mounting pairs of said yarn bobbins on each of said supports with bobbins in the first row being axially opposed to bobbins in the second row; and, means on each of said supports in the first and second rows to receive and guide yarn from said bobbins mounted in the other of said first or second row.

15. A creel for yarn bobbins, comprising:

two rows of yarn bobbin supports disposed in a manner which defines a plurality of alternating spatial sectors;

means for mounting at least two bobbins on each of said supports, such that pairs of said bobbins occupy each of said sectors; and, means on each of said supports for receiving and guiding yarn from both of said bobbins in each of said bobbin pairs, such that each of said yarn receiving and guiding means in one of said rows is operatively associated only with those of said yarn bobbins mounted in the other of said rows.

16. The creel of claim 15, wherein each of the bobbin pairs mounted in one of said two rows is axially directed to one each of the supports in the other of said two rows.

17. The creel of claim 15, wherein said spatial sectors are substantially triangular.

18. The creel of claim 15, wherein the bobbins in each of said bobbin pairs are axially directed to the same one of said yarn guiding and receiving means.

19. The creel of claim 15, wherein said yarn guiding and receiving means are disposed above said yarn bobbin mounting means.

20. The creel of claim 15, comprising at least two tiers of yarn bobbin mounting means.

21. A creel for yarn bobbins, comprising:

a plurality of yarn bobbin supports disposed alternately in two adjacent rows;

means for mounting at least two of said bobbins on each of said supports which are axially directed on one of said supports and opposed to bobbins of the other row; and means on each of said supports for receiving and guiding yarn from both of said bobbins.

* * * * *